US009212486B2

(12) United States Patent
Tanaka et al.

(10) Patent No.: US 9,212,486 B2
(45) Date of Patent: Dec. 15, 2015

(54) COLUMN STRUCTURE AND BASE MEMBER

(71) Applicant: Hitachi Metals Techno, Ltd., Koto-ku, Tokyo (JP)

(72) Inventors: Hidenori Tanaka, Tokyo (JP); Hideaki Takahashi, Tokyo (JP)

(73) Assignee: Hitachi Metals Techno, Ltd., Tokyo (JP)

( * ) Notice: Subject to any disclaimer, the term of this patent is extended or adjusted under 35 U.S.C. 154(b) by 0 days.

(21) Appl. No.: 14/345,948

(22) PCT Filed: Mar. 17, 2014

(86) PCT No.: PCT/JP2014/057081

§ 371 (c)(1),
(2) Date: Mar. 20, 2014

(65) Prior Publication Data

US 2015/0259915 A1 Sep. 17, 2015

(51) Int. Cl.

| | |
|---|---|
| ***E02D 27/00*** | (2006.01) |
| ***E04B 1/24*** | (2006.01) |
| ***E04C 3/32*** | (2006.01) |
| ***E02D 27/42*** | (2006.01) |

(52) U.S. Cl.
CPC .. *E04C 3/32* (2013.01); *E02D 27/42* (2013.01)

(58) Field of Classification Search
CPC ..... E04B 2001/2463; E04B 1/24; E04B 2001/2418; E04B 2001/2415; E02D 27/42; E02D 27/32; E02D 27/50; E04H 12/22; E04H 12/2261
USPC ..... 52/295, 169.13, 274, 296
See application file for complete search history.

(56) References Cited

U.S. PATENT DOCUMENTS 1,530,951 A * 3/1925 Krauss ..... 52/295
3,918,229 A * 11/1975 Schweinberger ..... 52/295
5,054,251 A * 10/1991 Kemeny ..... 52/167.8

(Continued)

FOREIGN PATENT DOCUMENTS

JP 04052320 A * 2/1992 ..... E02D 27/00
JP 05214731 A * 8/1993 ..... E02D 27/00

(Continued)

OTHER PUBLICATIONS

Partial English language translation of the following: Office action dated May 19, 2015 from the Japanese Patent Office in a Japanese patent application corresponding to the instant patent application. This office action translation is submitted now in order to supplement the understanding of the cited references which is being disclosed in the instant Information Disclosure Statement.

(Continued)

*Primary Examiner* — Christine T Cajilig
(74) *Attorney, Agent, or Firm* — SOLARIS Intellectual Property Group, PLLC

(57) ABSTRACT

In a column structure (10), a steel column (30) is joined to a base plate (16A). The steel column (30) is configured by a web (30A) and a pair of flanges (30B) provided at each of two width direction ends of the web (30A). A base plate (16A) is provided to first anchor bolts (24) and second anchor bolts (26) that are fixed to a foundation 12. The second anchor bolts (26) are provided further toward the web (30A) width direction inside than the first anchor bolts (24), and the yield deformation of the second anchor bolts (26) is set smaller than the yield deformation of the first anchor bolts (24).

4 Claims, 5 Drawing Sheets

(56) References Cited

U.S. PATENT DOCUMENTS

| | | | | | |
|---|---|---|---|---|---|
| 5,063,719 | A * | 11/1991 | Matsuo et al. | ..... | 52/296 |
| 6,931,804 | B2 * | 8/2005 | Trarup et al. | ..... | 52/295 |
| 8,850,765 | B2 * | 10/2014 | Amengual Pericas | ..... | 52/296 |
| 2002/0002806 | A1 * | 1/2002 | Commins et al. | ..... | 52/481.1 |
| 2002/0066245 | A1 * | 6/2002 | Pryor | ..... | 52/293.3 |
| 2003/0009964 | A1 * | 1/2003 | Trarup et al. | ..... | 52/295 |
| 2004/0148903 | A1 * | 8/2004 | Cash | ..... | 52/720.1 |
| 2012/0186168 | A1 * | 7/2012 | Mcphee | ..... | 52/98 |

FOREIGN PATENT DOCUMENTS

| | | | | | |
|---|---|---|---|---|---|
| JP | 06010408 | A * | 1/1994 | ..... | E04B 1/24 |
| JP | 2655774 | B2 | 9/1997 | | |
| JP | 09264029 | A * | 10/1997 | ..... | E02D 27/00 |
| JP | 10008555 | A * | 1/1998 | ..... | E04B 1/24 |
| JP | H11-286945 | A | 10/1999 | | |
| JP | 2002-146923 | | 5/2002 | | |
| JP | 2002339455 | A * | 11/2002 | ..... | E04B 1/24 |
| JP | 2003-232078 | | 8/2003 | | |
| JP | 2003239381 | A * | 8/2003 | ..... | E04B 1/24 |
| JP | 2004176482 | A * | 6/2004 | ..... | E04B 1/24 |
| JP | 2005-16212 | A | 1/2005 | | |
| JP | 2006-125157 | | 5/2006 | | |
| JP | 2008144425 | A * | 6/2008 | | |
| JP | 2009024367 | A * | 2/2009 | | |
| JP | 2009062717 | A * | 3/2009 | | |
| JP | 2009-256885 | * | 11/2009 | | |
| JP | 2009256885 | A * | 11/2009 | | |
| JP | 2009275390 | A * | 11/2009 | | |
| JP | 2011012402 | A * | 1/2011 | | |
| JP | 2012-7381 | A | 1/2012 | | |
| JP | 2012007382 | A * | 1/2012 | | |
| TW | 541388 | | 7/2003 | | |

OTHER PUBLICATIONS

English language translation of the following: Office action dated Aug. 26, 2015 from the Taiwan Patent Office in a Taiwanese patent application corresponding to the instant patent application. This office action translation is submitted now in order to supplement the understanding of the cited references which are being disclosed in the instant Information Disclosure Statement.

* cited by examiner

COLUMN STRUCTURE AND BASE MEMBER

TECHNICAL FIELD

The present invention relates to a column structure with a column member joined to an upper side of a base member, and to a base member that has an upper side for joining to a column member.

BACKGROUND ART

Japanese Patent No. 2655774 discloses a column base structure. In this column base structure, a base plate is fastened to anchor bolts that are fixed to a foundation, and an H-section steel column is attached to an upper face of the base plate through inverse T-shaped split tees. Upright plate portions of the split tees are fastened to the column using high strength bolts and nuts, and bottom plate portions of the split tees are fastened to the base plate similarly using high strength bolts and nuts.

In the above column base structure, tensile stress arises in the anchor bolts on the stress-imparted side when for example bending stress is imparted to the column in a web width direction. When plural anchor bolts in which web width direction tensile stress arises are provided, the greatest amount of yield deformation arises in the outermost anchor bolt(s). Since the yield bending capacity of the column base structure is determined by the outermost anchor bolt(s) regardless of the yield deformation of inside anchor bolts, there is accordingly room for improvement in raising the yield bending capacity of the column base structure.

DISCLOSURE OF INVENTION

Technical Problem

In consideration of the above circumstances, an object of the present invention is to obtain a column structure and a base member capable of raising yield bending capacity.

Solution to Problem

A column structure of a first aspect of the present invention includes: a column member that is integrally provided with a flange at each of two width direction sides of a web; a base member that has the column member joined to an upper side of the base member; a first anchor member including a lower end side that is fixed to a foundation, and including an upper end side to which the base member is fixed at the opposite side of the flange to the web side; and a second anchor member including a lower end side that is fixed to the foundation, and including an upper end side to which the base member is fixed at the web width direction inside of the first anchor member, the second anchor member having a smaller yield deformation than the first anchor member.

A column structure of a second aspect of the present invention is the column structure of the first aspect, wherein the first anchor member is formed from a material of higher strength than the material of the second anchor member.

A column structure of a third aspect of the present invention is the column structure of either the first aspect or the second aspect, wherein the first anchor member is formed with a longer axial direction length than the second anchor member.

A column structure of a fourth aspect of the present invention is the column structure of any one of the first aspect to the third aspect, wherein the second anchor member is closer to the flange than the first anchor member.

A column structure of a fifth aspect of the present invention is the column structure of any one of the first aspect to the fourth aspect, wherein an indented portion is provided to a lower side of the base member.

A base member of a sixth aspect of the present invention includes: a base body that has an upper side for joining to a column member integrally provided with a flange at each of two width direction sides of a web; a first fixing portion that is provided to the base body at the opposite side of the flange to the web side, and is fixed to an upper end side of a first anchor member, the first anchor member including a lower end side that is fixed to a foundation; and a second fixing portion that is provided to the base body at the web width direction inside of the first fixing portion, and is fixed to an upper end side of a second anchor member, the second anchor member including a lower end side that is fixed to the foundation, and having a smaller yield deformation than the first anchor member.

A base member of a seventh aspect of the present invention is the base member of the sixth aspect, wherein the second fixing portion is closer to the flange than the first fixing portion.

A base member of an eighth aspect of the present invention is the base member of either the sixth aspect or the seventh aspect, wherein an indented portion is provided to a lower side of the base body.

Advantageous Effects of Invention

In the column structure of the first aspect of the present invention, the column member that is integrally provided with the flange at each of two width direction sides of the web is joined to the upper side of the base member. The lower end sides of the first anchor member and the second anchor member are fixed to the foundation, and the upper end sides of the first anchor member and the second anchor member are fixed to the base member.

The upper end side of the first anchor member is fixed to the base member at the opposite side of the flange to the web side. The upper end side of the second anchor member is fixed to the base member at the web width direction inside of the first anchor member, and the yield deformation of the second anchor member is smaller than the yield deformation of the first anchor member. For example, when bending stress is imparted to the column member in the web width direction, this bending stress is transmitted to the foundation through the base member, the first anchor member and the second anchor member. When this occurs, the bending stress is effectively absorbed due to varying the yield deformation between the first anchor member and the second anchor member, such that yield deformation can be made to occur in both the first anchor member and the second anchor member. The yield bending capacity of the column structure can accordingly be raised.

In the column structure of the second aspect of the present invention, the first anchor member is formed from a material of higher strength than the material of the second anchor member, such that the yield deformation of the second anchor member is smaller than the yield deformation of the first anchor member.

In the column structure of the third exemplary embodiment of the present invention, the first anchor member is formed with a longer axial direction length than the second anchor member, such that the yield deformation of the second anchor member is smaller than the yield deformation of the first anchor member.

In the column structure of the fourth aspect of the present invention, the first anchor member is formed with a greater shaft diameter than the second anchor member, such that the yield deformation of the second anchor member is smaller than the yield deformation of the first anchor member.

In the column structure of the fifth aspect of the present invention, the second anchor member is closer to the flange than the first anchor member, thereby reducing the distance between the column member and the second anchor member. The thickness of the base member is determined by the tensile strength of the second anchor member and by the distance between the second anchor member and the column member. Since the distance between the second anchor member and the column member is reduced, the thickness of the base member can be made thinner.

In the column structure of the sixth aspect of the present invention, the indented portion is provided to the lower side of the base member, and the indented portion is anchored to the foundation, thereby suppressing horizontal direction displacement of the base member.

In the base member of the seventh aspect of the present invention, the column member that is integrally provided with a flange at each of two width direction sides of the web is joined to the upper side of the base body. The lower end sides of the first anchor member and the second anchor member are fixed to the foundation, the upper end side of the first anchor member is fixed to the first fixing portion of the base body, and upper end side of the second anchor member is fixed to the second fixing portion of the base body.

On the base body, the first fixing portion is fixed to the upper end side of the first anchor member at the opposite side of the flange to the web side. The second fixing portion is fixed to the upper end side of the second anchor member at the base body web width direction inside of the first anchor member, and the second anchor member has a smaller yield deformation than the yield deformation of the first anchor member. For example, when bending stress is imparted to the column member in the web width direction, this bending stress is transmitted to the foundation through the base body, the first anchor member and the second anchor member. When this occurs, the bending stress is effectively absorbed due to varying the yield deformation between the first anchor member and the second anchor member, such that yield deformation can be made to occur in both the first anchor member and the second anchor member. The yield bending capacity of the column structure can accordingly be raised by the base member.

In the base member of the eighth aspect of the present invention, the second fixing portion is closer to the flange than the first fixing portion, thereby reducing the distance between the column member and the second fixing portion. The thickness of the base body is determined by the tensile strength of the second anchor member and by the distance between the second fixing portion and the column member. Since the distance between the second fixing portion and the column member is reduced, the thickness of the base body can be made thinner.

In the base member of the ninth aspect of the present invention, the indented portion is provided to the lower side of the base body, and the indented portion is anchored to the foundation, thereby suppressing horizontal direction displacement of the base body.

BEST MODE FOR CARRYING OUT THE INVENTION

First Exemplary Embodiment

Figure 1:
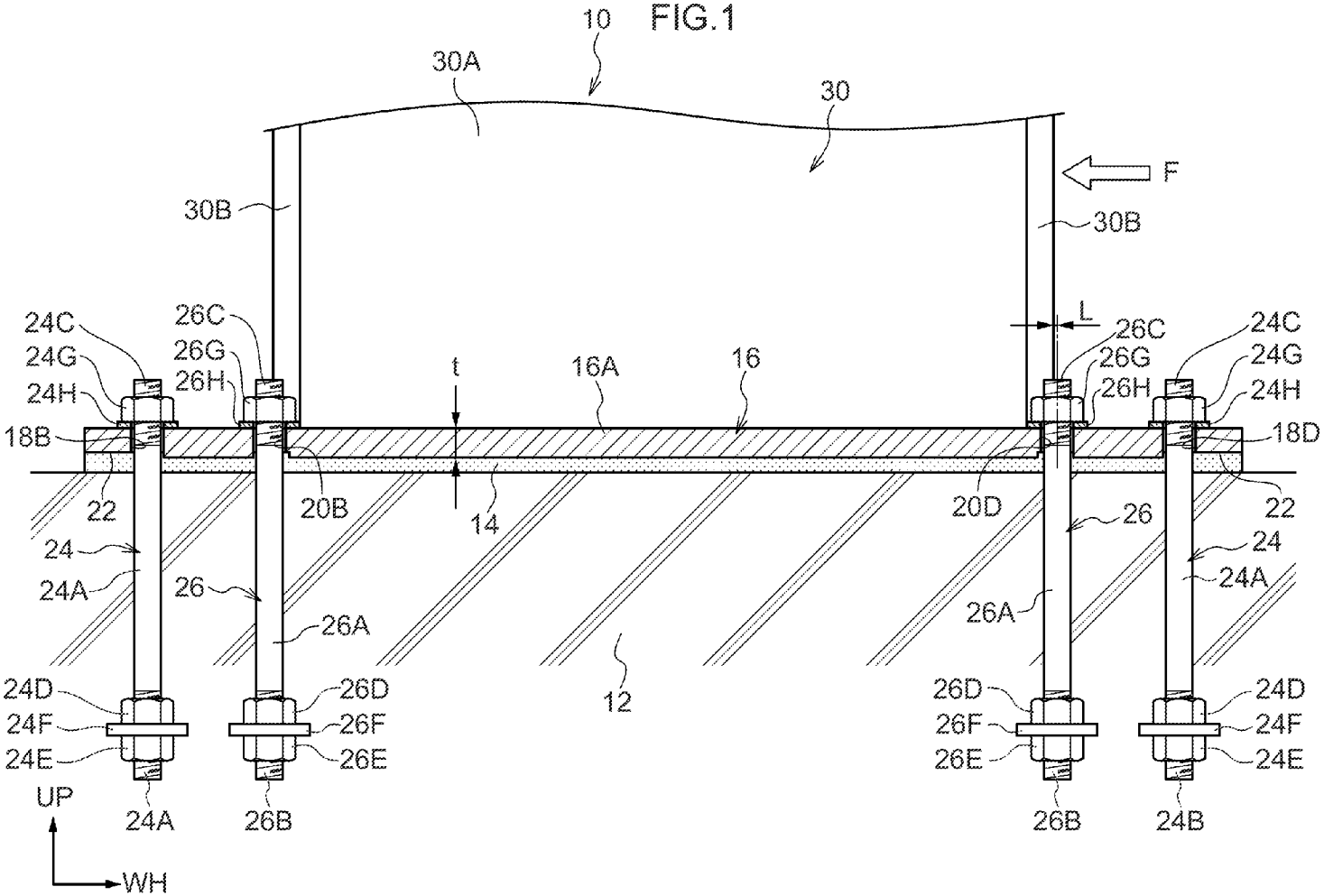
FIG. 1 is a cross-section of a column structure and base member according to a first exemplary embodiment of the present invention, as viewed along a flange width direction (taken along line A-A in FIG. 2).
Figure 2:
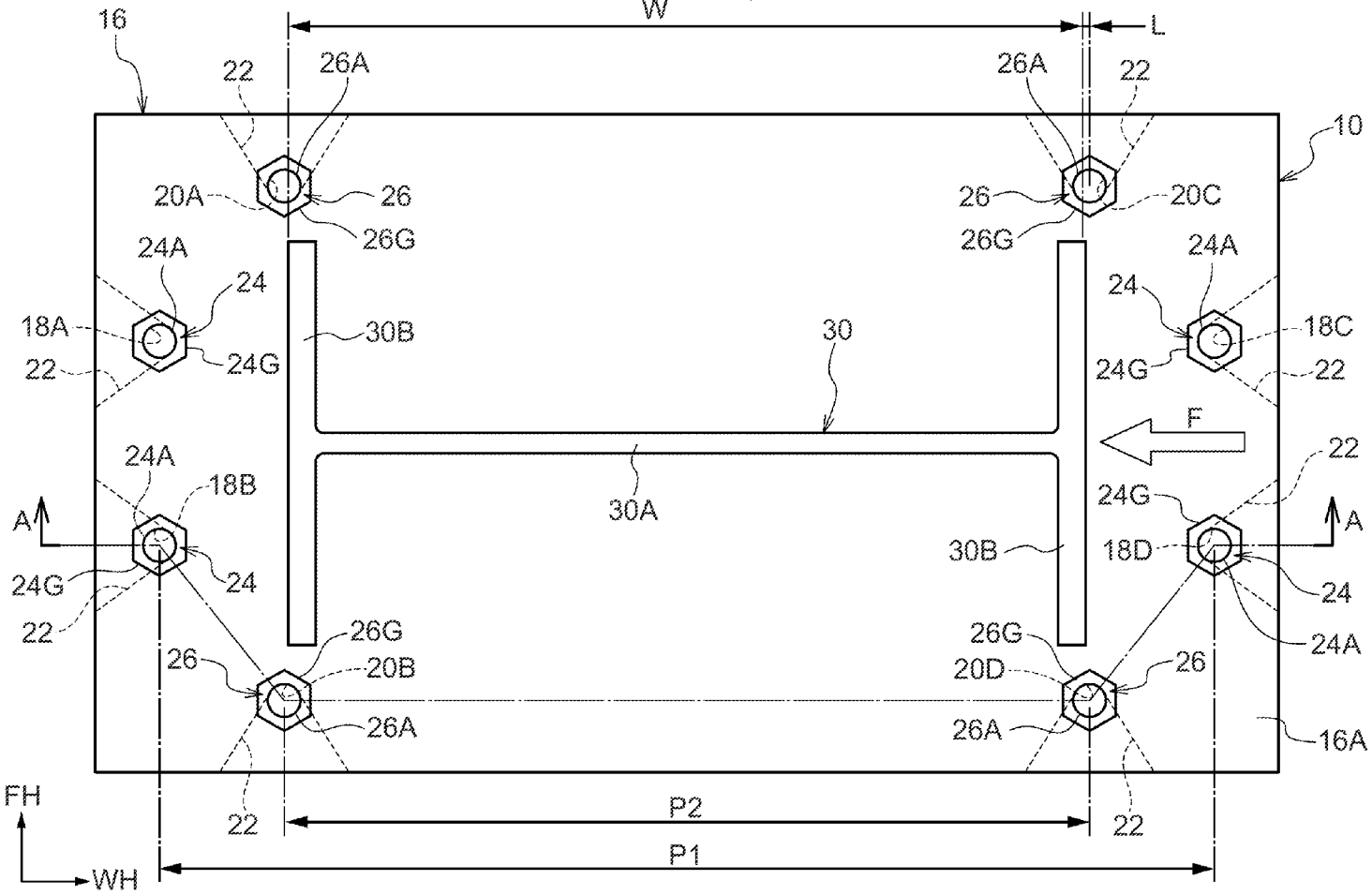
FIG. 2 is a plan view of a column structure and a base member according to the first exemplary embodiment.

Explanation follows regarding a column structure and a base member according to a first exemplary embodiment of the present invention, with reference to FIG. 1 and FIG. 2. Note that in the present exemplary embodiment an H-section steel column (H-section structural steel column) is employed as a column member, and in the drawings the arrow WH direction indicates a width direction of a web of the column member, and the arrow FH direction indicates a width direction of flanges of the column member as appropriate. The arrow UP direction indicates upwards.

Column Structure and Base Member Configuration

As illustrated in FIG. 1 and FIG. 2, a column structure 10 according to the present exemplary embodiment is placed on a foundation 12. The foundation 12 is, for example, concrete, and an upper face of the foundation 12 is formed as a horizontal and flat plane shape. Although not illustrated in the drawings, reinforcement is laid inside the foundation 12, raising the strength of the foundation 12.

Mortar 14 is provided as a fixing member on the upper surface of the foundation 12. The mortar 14 is formed, for example, in a rectangular shape in plan view.

A base member 16 is fixed to an upper face of the mortar 14. The base member 16 is provided with a base plate 16A, as a base body. The mortar 14 is disposed across the entire lower side of the base plate 16A. The base plate 16A is configured in a rectangular flat plate shape with its length direction along the arrow WH direction and its short direction along the arrow FH direction. More specifically, the base plate 16A is formed for example from a metal material, such as SN490B hot-rolled structural steel plate for construction according to Japanese Industrial Standard (JIS) specification G3136, or cast steel.

Two first fixing holes, a first fixing hole 18A and a first fixing hole 18B, are provided as first fixing portions at a short direction intermediate portion at one length direction end portion of the base plate 16A, illustrated on the left hand side in the drawings. Two first fixing holes, a first fixing hole 18C and a first fixing hole 18D are provided as first fixing portions at a short direction intermediate portion at the other length direction end portion of the base plate 16A, illustrated on the right hand side in the drawings. The first fixing holes 18A to 18D are formed as circular shaped through holes having the same diameter as each other in plan view. The position of the center axis of the first fixing hole 18A and the position of the center axis of the first fixing hole 18B are aligned with each other along the arrow FH direction. The position of the center axis of the first fixing hole 18C and the position of the center axis of the first fixing hole 18D are aligned with each other along the arrow FH direction. Moreover, the position of the center axis of the first fixing hole 18A and the position of the center axis of the first fixing hole 18C are aligned with each other along the arrow WH direction. The position of the center axis of the first fixing hole 18B and the position of the center axis of the first fixing hole 18D are aligned with each other along the arrow WH direction.

Two second fixing holes, a second fixing hole 20A and a second fixing hole 20B, are provided as second fixing portions at both short direction end portions at the one length direction end portion of the base plate 16A, illustrated on the left hand side in the drawings. Two second fixing holes, a second fixing hole 20C and a second fixing hole 20D, are provided as second fixing portions at both short direction end portions at the other length direction end portion of the base plate 16A, illustrated on the right hand side in the drawings. The second fixing holes 20A to 20D are formed as circular shaped through holes having the same diameter as the first fixing holes 18A to 18D.

The position of the center axis of the second fixing hole 20A and the position of the center axis of the second fixing hole 20B are aligned with each other along the arrow FH direction. In addition, the respective positions of the center axes of the second fixing hole 20A and the second fixing hole 20B are configured further toward the arrow WH direction inside than the respective positions of the center axes of the first fixing hole 18A and the first fixing hole 18B, so as to be further toward a length direction central portion of the base plate 16A. Namely, the respective positions of the center axes of the second fixing hole 20A and the second fixing hole 20B are brought closer to flanges 30B of a steel column 30, described later, than the respective positions of the center axes of the first fixing hole 18A and the first fixing hole 18B. Moreover, the position of the center axis of the second fixing hole 20A is configured further to the arrow FH direction outside than the position of the center axis of the first fixing hole 18A. The position of the center axis of the second fixing hole 20B is configured further to the arrow FH direction outside than the position of the center axis of the first fixing hole 18B.

The position of the center axis of the second fixing hole 20C and the position of the center axis of the second fixing hole 20D are aligned with each other along the arrow FH direction. In addition, the respective positions of the center axes of the second fixing hole 20C and the second fixing hole 20D are configured further toward the arrow WH direction inside than the respective positions of the center axes of the first fixing hole 18C and the first fixing hole 18D, so as to be further toward a length direction central portion of the base plate 16A. Similarly, the respective positions of the center axes of the second fixing hole 20C and the second fixing hole 20D are brought closer to the flanges 30B than the respective positions of the center axes of the first fixing hole 18C and the first fixing hole 18D. Moreover, the position of the center axis of the second fixing hole 20C is configured further to the arrow FH direction outside than the position of the center axis of the first fixing hole 18C. The position of the center axis of the second fixing hole 20D is configured further to the arrow FH direction outside than the position of the center axis of the first fixing hole 18D. The base plate 16A is accordingly provided with the four fixing holes of the first fixing hole 18A, the first fixing hole 18B, the second fixing hole 20A, and the second fixing hole 20B disposed at the one length direction end portion, and the four fixing holes of the first fixing hole 18C, the first fixing hole 18D, the second fixing hole 20C and the second fixing hole 20D at the other length direction end portion. The base plate 16A is thus provided with a total of eight first fixing portions and second fixing portions in the present exemplary embodiment.

Indented portions 22 are formed to a lower face of the base plate 16A at the periphery of each of the first fixing holes 18A to 18D and the second fixing holes 20A to 20D. The horizontal direction upper face (bottom faces of the indented portions 22) of each of the indented portions 22 is configured with a flat plane shape. The indented portions 22 are formed in substantially triangular shapes in plan view, and gradually widen on progression toward the outer peripheral side of the base plate 16A, with the indented portion 22 open to the outside of the outer periphery of the base plate 16A. At a base plate 16A center side portion, the vertical direction peripheral face of each of the indented portions 22 is configured in the same plane as an inner face of the respective first fixing holes 18A to 18D and the second fixing holes 20A to 20D. The mortar 14 fills the whole of the indented portions 22, and the base plate 16A is fixed to the foundation 12 with the mortar 14 interposed therebetween.

First anchor bolts (anchor locks) 24 as first anchor members and second anchor bolts (anchor locks) 26 serving as second anchor members are fixed to the foundation 12. The first anchor bolts 24 are each equipped with a circular rod shaped anchor body 24A, with the anchor body 24A disposed with its axial direction along the up-down direction. Except for an upper end portion 24C, most of the anchor body 24A, including a lower end portion 24B, pierces through the mortar 14 and is buried in the foundation 12. Similarly, the second anchor bolts 26 are each equipped with a circular rod shaped anchor body 26A, with the anchor body 26A disposed with its axial direction along the up-down direction. Except for an upper end portion 26C, most of the anchor body 26A, including a lower end portion 26B, pierces through the mortar 14 and is buried in the foundation 12

A male thread is provided to the lower end portion 24B of the anchor body 24A in each of the first anchor bolts 24. Two nuts, a nut 24D and a nut 24E, are provided screwed onto the male thread in the up-down direction. A circular ring flat plate shaped fixing plate 24F configuring an anchor portion is interposed between the nut 24D and the nut 24E, so as to project further to the outside than the shaft diameter of the anchor body 24A. The fixing plate 24F is fixed by tightening of the nut 24D and the nut 24E. The nut 24D, the nut 24E and the fixing plate 24F are buried in the foundation 12, and are configured to prevent the first anchor bolt 24 from being pulled out.

The upper end portions 24C of the anchor bodies 24A are respectively configured so as to pierce through and project out from the first fixing holes 18A to 18D of the base plate 16A. A male thread is provided to the upper end portion 24C, and a nut 24G for fixing the base plate 16A is screwed onto the male thread. A circular ring flat plate shaped washer 24H is interposed between the base plate 16A and the nut 24G.

Similarly in each of the second anchor bolts 26, two nuts, a nut 26D and a nut 26E, are screwed onto a male thread provided to the lower end portion 26B of the anchor body 26A. A circular ring flat plate shaped fixing plate 26F is interposed between the nut 26D and the nut 26E. The fixing plate 26F is fixed by tightening of the nut 26D and the nut 26E. The nut 26D, the nut 26E and the fixing plate 26F are buried in the foundation 12, and are configured to prevent the second anchor bolt 26 from being pulled out.

The upper end portions 26C of the anchor bodies 26A are respectively configured so as to pierce through and project out from the second fixing holes 20A to 20D of the base plate 16A. A male thread is provided to the upper end portion 26C, and a nut 26G for fixing the base plate 16A is screwed onto the male thread. A circular ring flat plate shaped washer 26H is interposed between the base plate 16A and the nut 26G.

In the present exemplary embodiment, the first anchor bolts 24 and the second anchor bolts 26 are formed with the same diameters as each other, and with the same axial direction lengths. However, the first anchor bolts 24 are formed from a higher strength material than that of the second anchor bolts 26. More specifically, the first anchor bolts 24 employ for example anchor bolts formed from a carbon steel material having a tensile strength of 490 $N/mm^2$ as defined by JIS specification G3138 or a stainless steel having a tensile strength of 520 $N/mm^2$ as defined by JIS specification G4321. The second anchor bolts 26 employ for example anchor bolts formed from a carbon steel material having a tensile strength of 400 $N/mm^2$ as defined by JIS specification G3138. In a case in which the first anchor bolts 24 are formed from a stainless steel, the second anchor bolts 26 may be formed from a carbon steel material having a tensile strength of 490 $N/mm^2$. Namely, in the present exemplary embodiment the second anchor bolts 26 are set with a smaller yield deformation, and the first anchor bolts 24 are formed so as to have a larger yield deformation.

At a center portion on the upper face of the base plate 16A, the steel column 30 is provided as the column member, with its length direction extending in the up-down direction. A lower end of the steel column 30 is joined, for example by arc welding, to the upper face of the base plate 16A.

The steel column 30 is, in the present exemplary embodiment, formed from H-section steel, and includes a web 30A and a pair of flanges 30B that are integrally provided at the two width direction ends of the web 30A. The web 30A of the steel column 30 is formed in an elongated rectangular flat plate shape with its width direction running along the arrow WH direction and its length direction running along the arrow UP direction. The pair of flanges 30B are each formed in an elongated rectangular flat plate shape with their width directions running along the arrow FH direction and with their length directions running along the arrow UP direction. The two ends of the web 30A are integrally joined to width direction central portions of the flanges 30B. The steel column 30 is, for example formed from a rolled structural steel for use in construction as defined by JIS specification G3136, a rolled steel for use in welded structures as defined by JIS specification G3106, or a rolled steel for use in general purpose structures as defined by JIS specification G3101.

Note that normally there are plural of the column structures 10 provided in a building. Although not illustrated in the drawings, foundation beams span across between lower end portions of the steel columns 30 of adjacent column structures 10, so as to arrange the main foundation beam layout.

Operation and Advantageous Effects of the First Exemplary Embodiment

As illustrated in FIG. 1 and FIG. 2, in the column structure 10 and the base member 16 according to the present exemplary embodiment, the steel column 30 integrally provided with the flanges 30B at both width direction end sides of the web 30A is joined to the upper side of the base plate 16A. The lower end portions 24B of the first anchor bolts 24 and the lower end portions 26B of the second anchor bolts 26 are fixed to the foundation 12, and the base plate 16A is fixed to the upper end portions 24C of the first anchor bolts 24 and the upper end portions 26C of the second anchor bolts 26.

The upper end portions 24C of the first anchor bolts 24 are fixed to the base plate 16A at the opposite side of the flanges 30B to the web 30A side. The upper end portions 26C of the second anchor bolts 26 are fixed to the base plate 16A further to the web 30A width direction inside than the first anchor bolts 24, and the yield deformation of the second anchor bolts 26 is configured smaller than the yield deformation of the first anchor bolts 24. Namely, the yield deformation of the first anchor bolts 24 differs from the yield deformation of the second anchor bolts 26 along the web 30A width direction that is aligned with the strong axial direction of the steel column 30. In other words, the yield displacement of the first anchor bolts 24 is larger than the yield displacement of the second anchor bolts 26.

For example in the column structure 10 illustrated in FIG. 2, the width (column width) W of the steel column 30 is set at 600 mm, a separation P1 between the first anchor bolts 24 is set at 800 mm, and a separation P2 between the second anchor bolts 26 is set at 600 mm. In this case, the first anchor bolts 24 are set with a strength of from 1.2 times to 1.5 times the strength of the second anchor bolts 26. When horizontal direction load arises for example during an earthquake, it is anticipated that force will act on the steel column 30 in the arrow F direction, along the web 30A width direction (strong axial direction). Such a force F acts about a center of rotation in the vicinity of the center of the base plate 16A, and is bending stress that is transmitted from the steel column 30, through the base plate 16A, the first anchor bolts 24 and the second anchor bolts 26 into the foundation 12. This bending stress deforms the first anchor bolts 24 disposed further toward the outside more heavily than the second anchor bolts 26 that are disposed toward the base plate 16A inside. In the present exemplary embodiment, the yield displacement of the first anchor bolts 24 is set larger than the yield displacement of the second anchor bolts 26. Accordingly, yield deformation occurs in response to bending stress in both the first anchor bolts 24 and the second anchor bolts 26. By setting the strength ratio between the first anchor bolts 24 and the second anchor bolts 26 with the values described above, yield deformation of the first anchor bolts 24 and the second anchor bolts 26 occurs at substantially the same time. Since both the first anchor bolts 24 and the second anchor bolts 26 are caused to undergo yield deformation, the bending stress is efficiently absorbed, thereby enabling the yield bending capacity of the column structure 10 to be raised.

In the column structure 10 and the base member 16 according to the present exemplary embodiment, the first anchor bolts 24 are formed from a higher strength material than that of the second anchor bolts 26, such that the yield deformation of the second anchor bolts 26 is smaller than the yield deformation of the first anchor bolts 24.

Moreover, in the column structure 10 and the base member 16 according to the present exemplary embodiment, as illustrated in FIG. 1 and FIG. 2, the second fixing holes 20A to 20D or the second anchor bolts 26 are brought closer to the flanges 30B than the first fixing holes 18A to 18D or the first anchor bolts 24. Accordingly, a separation distance L from the flanges 30B of the steel column 30 to the second fixing holes 20A to 20D or the second anchor bolts 26 is made small. Note that an increase in the total number of the first anchor bolts 24 and the second anchor bolts 26 provided to a single base plate 16A (or the total number of holes of the first fixing holes 18A to 18D and the second fixing holes 20A to 20D) necessitates an increase in the thickness (up-down direction thickness dimension) t of the base plate 16A.

The total number of the first anchor bolts 24 and the second anchor bolts 26 provided at the periphery of one of the pair of flanges 30B of the base plate 16A is denoted n. In the present exemplary embodiment, n equals 4. The yield tensile strength in the axial direction of the $i^{th}$ first anchor bolt 24 or second anchor bolt 26 in the arrow FH direction is denoted Ti. The arrow WH direction separation distance between the center axis of the $i^{th}$ first anchor bolt 24 or second anchor bolt 26 and the flange 30B is denoted Li. Moreover, the arrow FH direction dimension of the base plate 16A (width dimension) is denoted B, and the thickness of the base plate 16A is denoted t, and the yield point of the base plate 16A material is denoted σ. In this case, the base plate 16A conforms to the following relationship expression (1).

$$\sum_{i=1}^{n} TiLi \leq B(t^2/6)\sigma$$

In the above relationship expression, reducing the separation distance Li on the left side reduces the thickness t on the right side. Namely, in the present exemplary embodiment, by actively reducing the separation distance Li, the thickness of the base plate 16A can be made thinner. The material costs of the base plate 16A can be reduced, thereby enabling a saving in material costs and manufacturing costs of the column structure 10.

Moreover, in the column structure 10 and the base member 16 according to the present exemplary embodiment, the indented portions 22 are provided at the base plate 16A lower side. The mortar 14 fills the indented portions 22, and the base plate 16A is anchored to the foundation 12 through the mortar 14. Thus when horizontal direction load arises such as during an earthquake, displacement of the base member 16 with respect to the foundation 12 can be suppressed. This thereby enables the shear capacity of the column structure 10 and the base member 16 to be raised since shear stress is effectively suppressed from being transmitted from the steel column 30 to the foundation 12 through the base plate 16A and the first anchor bolts 24 and the second anchor bolts 26.

Second Exemplary Embodiment

Figure 3:
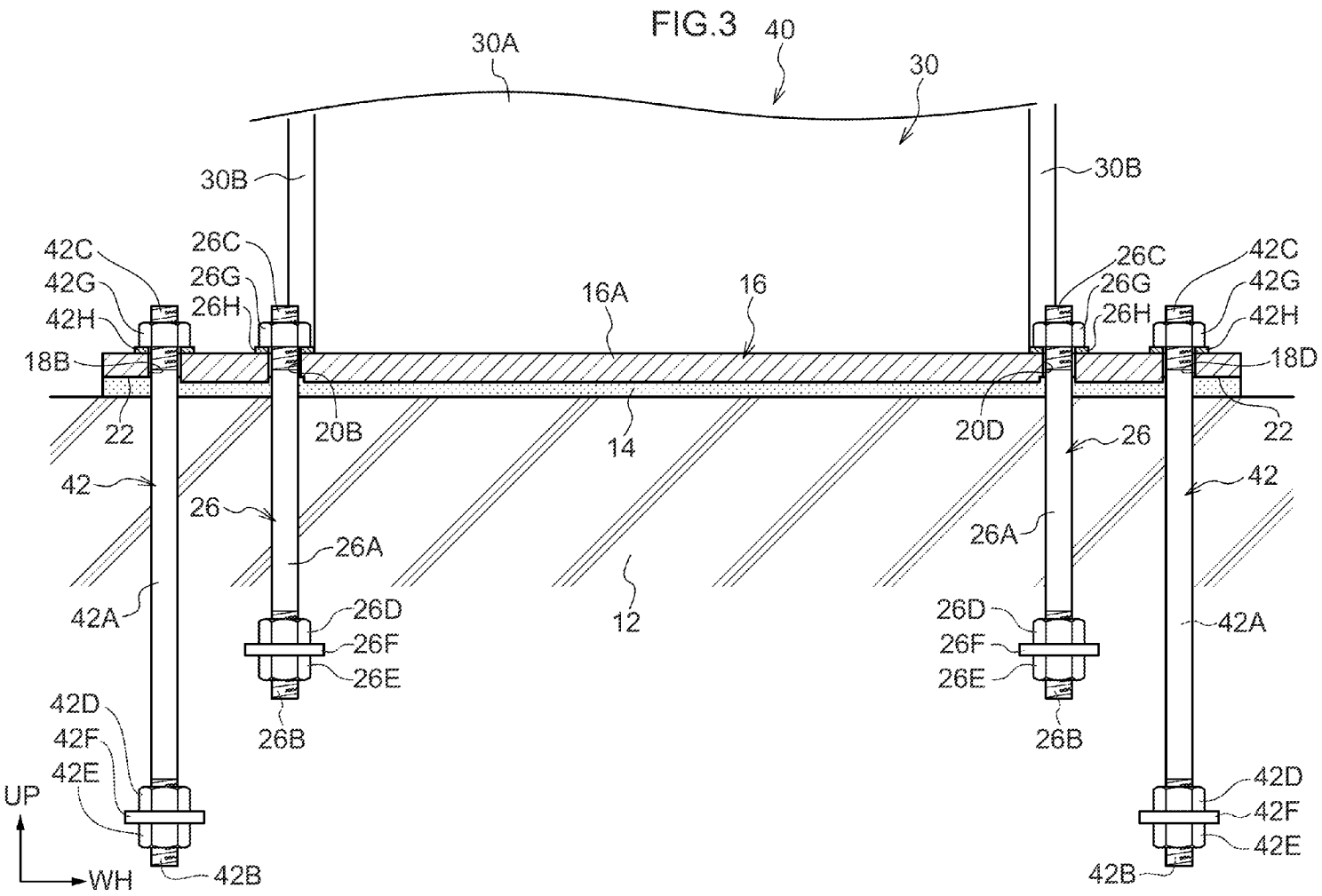
FIG. 3 is a cross-section corresponding to FIG. 1 of a column structure and base member according to a second exemplary embodiment of the present invention.

Explanation follows regarding a column structure and base member according to a second exemplary embodiment of the present invention, with reference to FIG. 3. Note that in the present exemplary embodiment, as well as in subsequently described exemplary embodiments, configuration that is the same as configuration of the column structure 10 and the base member 16 according to the first exemplary embodiment is appended with the same reference numerals, and repetition of explanation of such configurations is omitted.

Column Structure and Base Member Configuration

As illustrated in FIG. 3, in a column structure 40 and a base member 16 according to the present exemplary embodiment the configuration of first anchor bolts 42 serving as first anchor members differs from the configuration of the first anchor bolts 24 of the first exemplary embodiment. Other configurations of the column structure 40 and the base member 16 according to the present exemplary embodiment are similar to configurations of the column structure 10 and the base member 16 according to the first exemplary embodiment.

More specifically, each first anchor bolt 42 has two nuts, a nut 42D and a nut 42E screwed onto a male thread provided at a lower end portion 42B of an anchor body 42A. A circular ring flat plate shaped fixing plate 42F is interposed between the nut 42D and the nut 42E. The fixing plate 42F is fixed by tightening of the nut 42D and the nut 42E. The nut 42D, the nut 42E and the fixing plate 42F are buried in the foundation 12, and are configured to prevent the first anchor bolt 42 from being pulled out. Upper end portions 42C of the anchor bodies 42A are respectively configured so as to pierce through and project out from the first fixing holes 18A to 18D of the base plate 16A. A male thread is provided to the upper end portion 42C, and a nut 42G for fixing the base plate 16A is screwed onto the male thread. A circular ring flat plate shaped washer 42H is interposed between the base plate 16A and the nut 42G.

The axial direction length of the anchor bodies 42A of the first anchor bolts 42 is formed longer than the axial direction length of the anchor bodies 26A of the second anchor bolts 26. In the present exemplary embodiment, the shaft diameter of the anchor bodies 42A is the same as the shaft diameter of the anchor bodies 26A. Under the same conditions as in the first exemplary embodiment, the anchor bodies 42A are set with a length of from 1.2 times to 1.5 times the length of the anchor bodies 26A.

Operation and Advantageous Effects of the Second Exemplary Embodiment

In the column structure 40 and the base member 16 according to the present exemplary embodiment, the first anchor bolts 42 are formed with a greater axial direction length than the second anchor bolts 26, such that the yield deformation of the second anchor bolts 26 is smaller than the yield deformation of the first anchor bolts 42. The yield bending capacity of the column structure 40 and the base member 16 can accordingly be raised.

In addition to the above operation and advantageous effects, the column structure 40 and the base member 16 according to the present exemplary embodiment can obtain similar operation and advantageous effects to those obtained by the column structure 10 and the base member 16 according to the first exemplary embodiment.

Third Exemplary Embodiment

Figure 4:
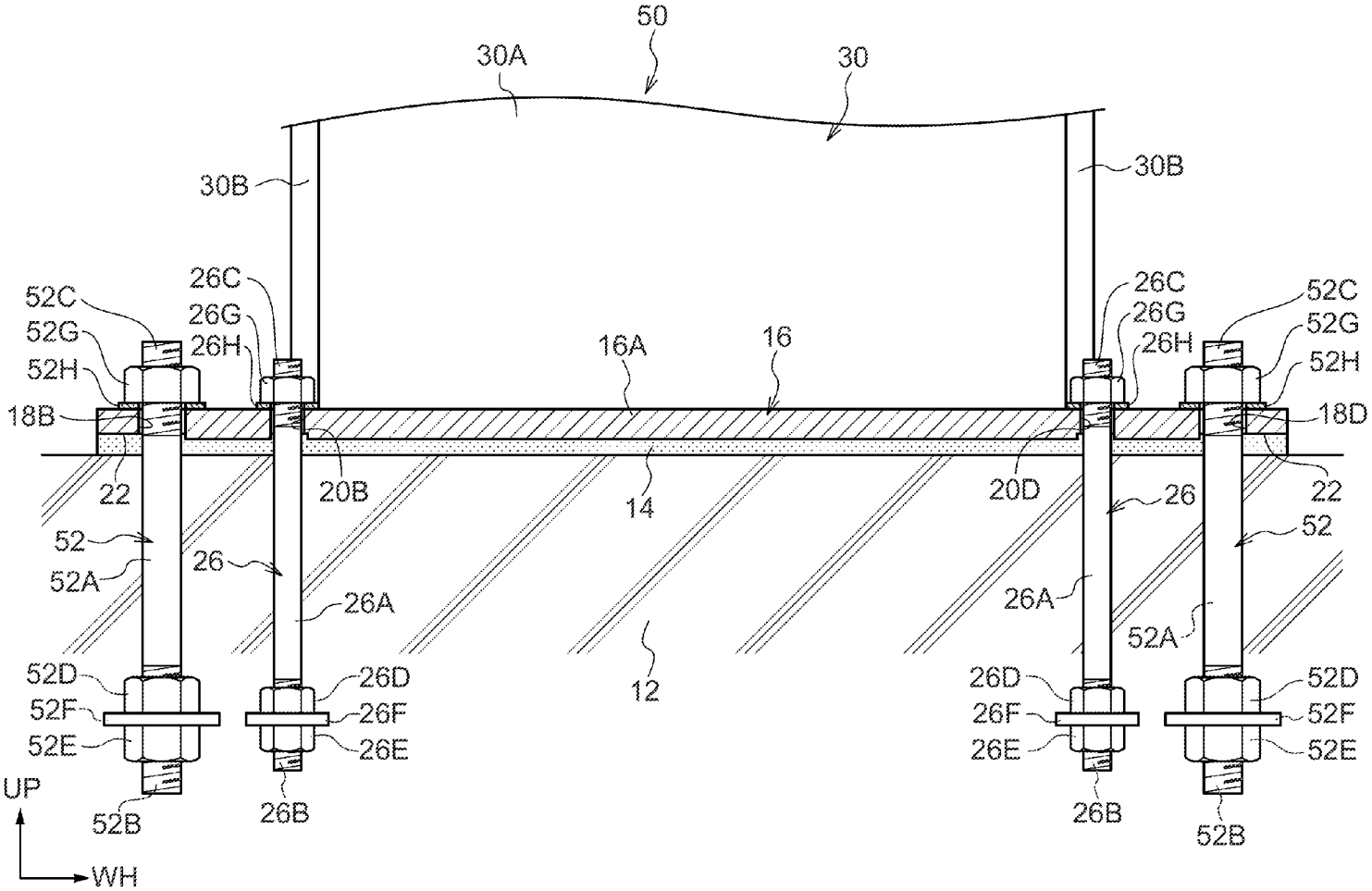
FIG. 4 is a cross-section corresponding to FIG. 1 of a column structure and base member according to a third exemplary embodiment of the present invention.

Explanation follows regarding a column structure and base member according to a third exemplary embodiment, with reference to FIG. 4.

Column Structure and Base Member Configuration

As illustrated in FIG. 4, in a column structure 50 and a base member 16 according to the present exemplary embodiment, the configuration of first anchor bolts 52 serving as first anchor members differs from the configuration of the first anchor bolts 24 of the first exemplary embodiment. Other configurations of the column structure 50 and the base member 16 according to the present exemplary embodiment are similar to the configuration of the column structure 10 and the base member 16 according to the first exemplary embodiment.

More specifically, each first anchor bolt 52 has two nuts, a nut 52D and a nut 52E screwed onto a male thread provided at a lower end portion 52B of an anchor body 52A. A circular ring flat plate shaped fixing plate 52F is interposed between the nut 52D and the nut 52E. The fixing plate 52F is fixed by tightening of the nut 52D and the nut 52E. The nut 52D, the nut 52E and the fixing plate 52F are buried in the foundation 12, and are configured to prevent the first anchor bolt 52 from being pulled out. Upper end portions 52C of the anchor bodies 52A are respectively configured so as to pierce through and project out from the first fixing holes 18A to 18D of the base plate 16A. A male thread is provided to the upper end portion 52C, and a nut 52G for fixing the base plate 16A is screwed onto the male thread. A circular ring flat plate shaped washer 52H is interposed between the base plate 16A and the nut 52G.

The shaft diameter of the anchor bodies 52A of the first anchor bolts 52 is formed larger than the shaft diameter of the anchor bodies 26A of the second anchor bolts 26, and the axial direction length of the anchor bodies 52A is formed longer than the axial direction length of the anchor bodies 26A of the second anchor bolts 26.

Operation and Advantageous Effects of the Third Exemplary Embodiment

In the column structure 50 and the base member 16 according to the present exemplary embodiment, the first anchor bolts 52 are formed with a greater shaft diameter and longer axial direction length than the second anchor bolts 26, such that the yield deformation of the second anchor bolts 26 is smaller than the yield deformation of the first anchor bolts 52. The yield bending capacity of the column structure 50 and the base member 16 can accordingly be raised.

In addition to the above operation and advantageous effects, the column structure 50 and the base member 16 according to the present exemplary embodiment can obtain similar operation and advantageous effects to those obtained by the column structure 10 and the base member 16 according to the first exemplary embodiment.

Fourth Exemplary Embodiment

Figure 5:
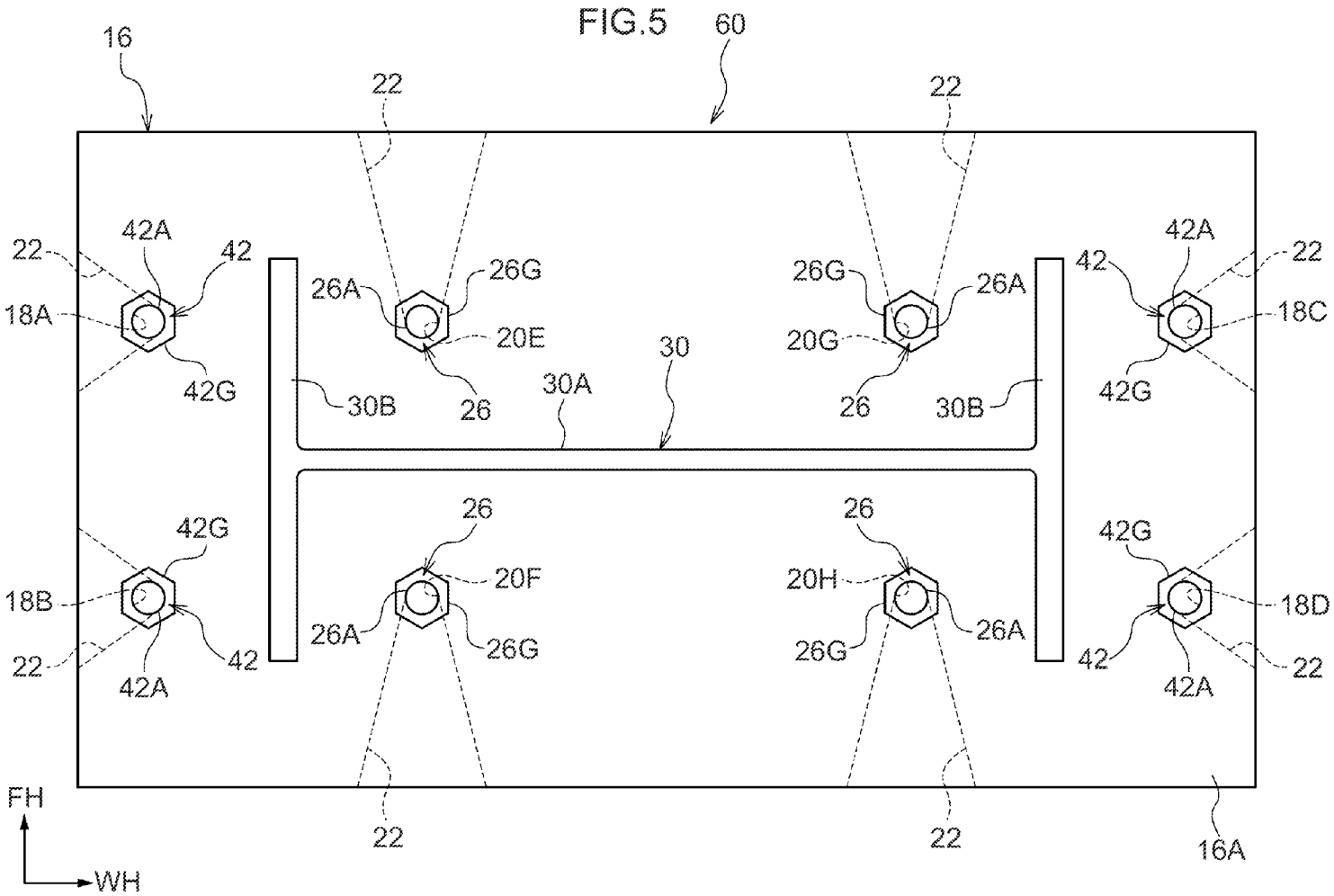
FIG. 5 is a plan view corresponding to FIG. 2 of a column structure and base member according to a fourth exemplary embodiment of the present invention.

Explanation follows regarding a column structure and base member according to a fourth exemplary embodiment of the present invention, with reference to FIG. 5. The present exemplary embodiment is a modified example of the column structure 40 and the base member 16 according to the second exemplary embodiment.

Column Structure and Base Member Configuration

As illustrated in FIG. 5, in a column structure 60 and a base member 16 according to the present exemplary embodiment, the placement positions on the base plate 16A of second fixing holes 20E to 20H, serving as second fixing portions, differ from the placement positions of the second fixing holes 20A to 20D serving as the second fixing portions in the second exemplary embodiment. Other configurations of the column structure 60 and the base member 16 according to the present exemplary embodiment are similar to the configuration of the column structure 40 and the base member 16 according to the second exemplary embodiment.

More specifically, the second fixing hole 20E of the present exemplary embodiment that corresponds to the second fixing hole 20A of the second exemplary embodiment is provided at the web 30A width direction (arrow WH direction) inside of the flange 30B. The placement position of the second fixing hole 20E is aligned with the placement position of the first fixing hole 18A along the web 30A width direction. The first anchor bolt 42 with the longer axial direction length is inserted through the first fixing hole 18A, and the upper end portion 42C of the first anchor bolt 42 is fixed to the base plate 16A (see FIG. 3). The second anchor bolt 26 with the shorter axial direction length is inserted through the second fixing hole 20E, and the upper end portion 26C of the second anchor bolt 26 is fixed to the base plate 16A.

Similarly, the second fixing hole 20F that corresponds to the second fixing hole 20B is provided at the web 30A width direction inside of the flange 30B, and the placement position of the second fixing hole 20F is aligned with the placement position of the first fixing hole 18B along the web 30A width direction. The second fixing hole 20G that corresponds to the second fixing hole 20C is provided at the web 30A width direction inside of the flange 30B, and the placement position of the second fixing hole 20G is aligned with the placement position of the first fixing hole 18C along the web 30A width direction. The second fixing hole 20H that corresponds to the second fixing hole 20D is provided at the web 30A width direction inside of the flange 30B, and the placement position of the second fixing hole 20H is aligned with the placement position of the first fixing hole 18D along the web 30A width direction. The first anchor bolts 42 are inserted through the first fixing holes 18B to 18D, and the upper end portions 42C of the first anchor bolts 42 are fixed to the base plate 16A. The second anchor bolts 26 are inserted through the second fixing holes 20F to 20H, and the upper end portions 26C of the second anchor bolts 26 are fixed to the base plate 16A.

Operation and Advantageous Effects of the Fourth Exemplary Embodiment

In the column structure 60 and the base member 16 according to the present exemplary embodiment, the upper end portions 26C of the second anchor bolts 26 are fixed to the base member 16 further toward the web 30A width direction inside than the flanges 30B. Due to providing the two first anchor bolts 42 and the two second anchor bolts 26 on both sides of the respective flanges 30B, the placement layout of the first anchor bolts 42 and the second anchor bolts 26 is alleviated. It is accordingly easy to form the layout of the foundation 12 accordingly avoiding the first anchor bolts 42 and the second anchor bolts 26.

In addition to the above operation and advantageous effects, the column structure 60 and the base member 16 according to the present exemplary embodiment can obtain similar operation and advantageous effects to those obtained by the column structure 40 and the base member 16 according to the second exemplary embodiment.

Note that the present exemplary embodiment may be applied to the column structure 10 and the base member 16 according to the first exemplary embodiment, or to the column structure 50 and the base member 16 according to the third exemplary embodiment. Namely, the first anchor bolts 42 of the present exemplary embodiment are configured by the first anchor bolts 24 in the case of the first exemplary embodiment, and are configured by the first anchor bolts 52 in the case of the third exemplary embodiment.

Other Exemplary Embodiments

The present invention is not limited to the exemplary embodiments described above, and various modifications are possible within a range not departing from the spirit of the present invention. For example, in the above exemplary embodiments, four anchor members (fixing portions) are respectively provided along the flange width direction at both web width direction ends of the base member. In the present invention, three or more anchor members may be respectively provided to one length direction end portion and the other length direction end portion of the base member. When there are a minimum of three anchor members, one first anchor member is provided at a flange width direction central portion, and one second anchor member is respectively provided at each flange width direction end portion.

In the above exemplary embodiments, the first anchor members and the second anchor members are provided in the web width direction, however third anchor members may be provided further to the web width direction inside than the second anchor members. In such cases, the yield deformation is set so as to decrease in sequence from the first anchor members to the third anchor members.

The invention claimed is:

1. A column structure comprising:

a column member that is integrally provided with a flange at each of two width direction sides of a web;

a base member that has the column member joined to an upper side of the base member;

a first anchor member including a lower end side that is fixed to a foundation, and including an upper end side to which the base member is fixed at the opposite side of the flange to the web side; and a second anchor member including a lower end side that is fixed to the foundation, and including an upper end side to which the base member is fixed at the web width direction inside of the first anchor member, the second anchor member having a smaller yield deformation than the first anchor member, and the second anchor member being closer to the flange than the first anchor member.

2. The column structure of claim 1, wherein the first anchor member is formed from a material of higher strength than the material of the second anchor member.

3. The column structure of claim 1, wherein the first anchor member is formed with a longer axial direction length than the second anchor member.

4. The column structure of claim 1, wherein an indented portion is provided to a lower side of the base member.

* * * * *